US009540861B2

(12) United States Patent
Abdul Lathief

(10) Patent No.: US 9,540,861 B2
(45) **Date of Patent: *Jan. 10, 2017**

(54) MULTI TENSIONED COMPOSITE PROFILE

(71) Applicant: Century Glass LLC, Dubai (AE)

(72) Inventor: Arakkal Abdul Khader Abdul Lathief, Dubai (AE)

(73) Assignee: CITY GLASS & GLAZING (P) LTD. (IN)

( * ) Notice: Subject to any disclaimer, the term of this patent is extended or adjusted under 35 U.S.C. 154(b) by 10 days.

This patent is subject to a terminal disclaimer.

(21) Appl. No.: 14/613,766

(22) Filed: Feb. 4, 2015

(65) Prior Publication Data

US 2015/0184684 A1 Jul. 2, 2015

Related U.S. Application Data

(63) Continuation-in-part of application No. 14/491,229, filed on Sep. 19, 2014, which is a continuation of (Continued)

(51) Int. Cl.
*E06B 3/54* (2006.01)
*E06B 3/58* (2006.01)

(Continued)

(52) U.S. Cl.
CPC ..... *E06B 3/5821* (2013.01); *E06B 3/549* (2013.01); *E06B 3/5871* (2013.01); *E06B 3/24* (2013.01);

(Continued)

(58) Field of Classification Search
CPC ..... E06B 3/5481; E06B 3/549; E06B 3/5821; E06B 3/5871; E06B 3/62; E06B 2003/5463; E06B 2003/5472; E06B 2003/6226

See application file for complete search history.

(56) References Cited

U.S. PATENT DOCUMENTS 2,264,187 A * 11/1941 Owen ..... E06B 3/26301 52/172
2,304,423 A * 12/1942 Schiller ..... E06B 3/5821 52/204.7

(Continued)

FOREIGN PATENT DOCUMENTS

CA 1070569 A1 1/1980
CN 2295835 Y 10/1998

(Continued)

OTHER PUBLICATIONS

International Search Report for PCT/IB2004/002298 mailed Nov. 30, 2004.

(Continued)

*Primary Examiner* — Ryan Kwiecinski
(74) *Attorney, Agent, or Firm* — Fishman Stewart PLLC

(57) ABSTRACT

A self-locking support system includes a female profile having a first profile leg extending approximately orthogonally from a base, a first locking leg extending from the first profile leg, and a first tip extending from the first profile leg, wherein a gap is formed between the base and the first profile leg, and a first male profile having a fulcrum formed at an intersection of a second profile leg and a second locking leg, the second profile leg having a second tip extending therefrom. When the second locking leg is inserted into the gap, and a locking bead is positioned between the first and second tips, the first male profile is caused to rotate about the fulcrum and the first and second locking legs are caused to engage against each other.

16 Claims, 13 Drawing Sheets

Related U.S. Application Data application No. 14/327,961, filed on Jul. 10, 2014, which is a continuation-in-part of application No. 14/148,188, filed on Jan. 6, 2014, now abandoned, which is a continuation of application No. 12/261,891, filed on Oct. 30, 2008, now Pat. No. 8,621,793, which is a continuation-in-part of application No. 10/566,536, filed as application No. PCT/IB2004/002298 on Jul. 15, 2004, now abandoned.

(51) Int. Cl.
*E06B 3/62* (2006.01)
*E06B 3/24* (2006.01)

(52) U.S. Cl.
CPC ... *E06B 2003/6226* (2013.01); *Y10T 29/49826* (2015.01); *Y10T 29/49959* (2015.01); *Y10T 403/608* (2015.01)

(56) References Cited

U.S. PATENT DOCUMENTS 3,155,205 A * 11/1964 Piace ..... E06B 3/5821 52/204.591
3,455,080 A * 7/1969 Meadows ..... E06B 3/549 52/204.597
3,774,363 A * 11/1973 Kent ..... B60J 10/70 52/204.597
3,881,290 A * 5/1975 Bouchey ..... E06B 3/5814 52/204.591
4,524,978 A * 6/1985 Mauser ..... E06B 3/305 277/637
4,612,743 A * 9/1986 Salzer ..... E06B 3/28 49/501
4,624,091 A * 11/1986 Biro ..... E06B 3/5821 52/204.593
4,689,933 A 9/1987 Biro
4,873,803 A * 10/1989 Rundo ..... E06B 3/5418 52/202
5,007,221 A 4/1991 Matthews et al.
5,692,349 A * 12/1997 Guillemet ..... E06B 3/5892 52/204.53
5,713,159 A 2/1998 Schmidt
5,768,837 A * 6/1998 Sjoholm ..... E06B 3/305 52/204.62
6,003,277 A 12/1999 Graham et al.
6,318,037 B1 11/2001 Hansen
6,792,724 B2 9/2004 Burgess
6,848,225 B2 * 2/2005 Lapierre ..... E06B 7/14 52/204.53
7,040,062 B2 * 5/2006 Emek ..... E06B 1/02 52/203
7,621,082 B2 * 11/2009 Morton ..... E06B 3/6621 52/204.54
8,621,793 B2 1/2014 Abdul Lathief
2002/0011040 A1 * 1/2002 Adachi ..... B60J 10/70 52/204.597
2003/0070371 A1 * 4/2003 Kobrehel ..... B60J 1/2094 52/204.5
2003/0159374 A1 * 8/2003 Burgess ..... E06B 3/685 52/204.61
2004/0231255 A1 * 11/2004 Silverman ..... E06B 3/24 52/204.6
2005/0055906 A1 * 3/2005 Barnard ..... E06B 3/5892 52/204.1
2005/0246980 A1 * 11/2005 Montero ..... E06B 3/5821 52/204.53
2006/0143996 A1 * 7/2006 Alvarado ..... E06B 1/02 52/204.53

FOREIGN PATENT DOCUMENTS

DE 2452087 A1 5/1976
DE 2614803 A1 10/1977
DE 29505234 U1 7/1995
EP 011901 A1 6/1980
GB 2141165 A * 12/1984 ..... E06B 3/34
GB 2144477 A 3/1985
GB 2178470 A 2/1987
GB 2179591 A 3/1987
GB 2227275 A * 7/1990 ..... E06B 3/5821
GB 2237600 A 5/1991
JP 10184208 7/1998
JP 11256942 9/1999
WO WO-2005010310 A1 2/2005

OTHER PUBLICATIONS

English Abstract for JP10184208.
English Abstract for JP11256942.
Bibliographic Data Sheet indicating no Abstract available for DE29505234U1.
English Abstract for CN2295835Y.
Bibliographic Data Sheet indicating no Abstract available for DE2614803-A1.

* cited by examiner

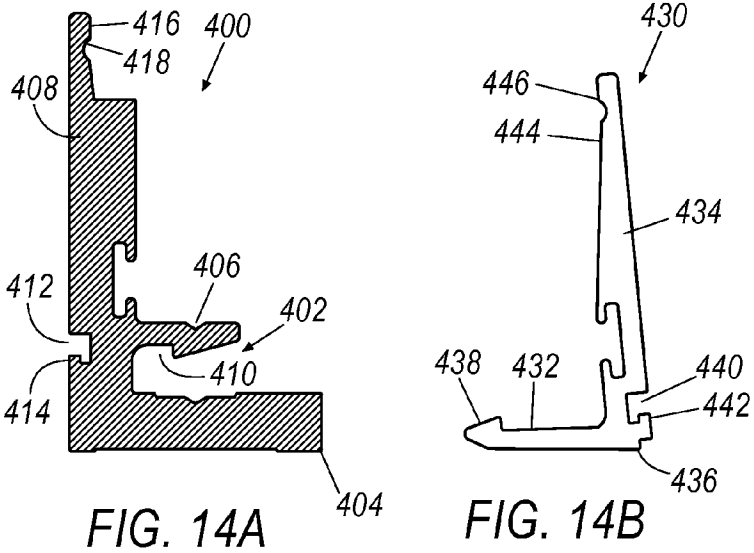
FIG. 14A
FIG. 14B
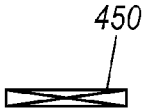
FIG. 14C
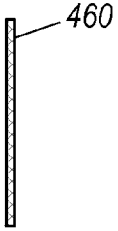
FIG. 14D
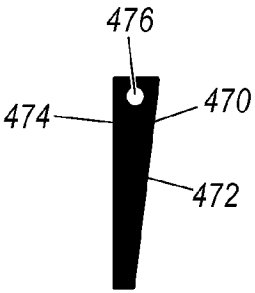
FIG. 14E
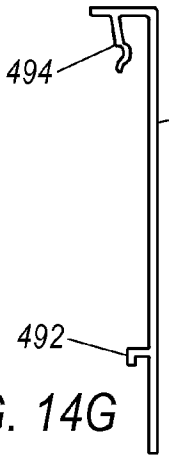
FIG. 14F
FIG. 14G

MULTI TENSIONED COMPOSITE PROFILE

CROSS-REFERENCE TO RELATED APPLICATIONS

This application is a continuation-in-part of U.S. patent application Ser. No. 14/491,229, filed on Sep. 19, 2014, which is a continuation of U.S. patent application Ser. No. 14/327,961, filed on Jul. 10, 2014, which is a continuation-in-part of Ser. No. 14/148,188, filed on Jan. 6, 2014, which claims the benefit of U.S. patent application Ser. No. 12/261,891, filed on Oct. 30, 2008 (now issued as U.S. Pat. No. 8,621,793), which is a continuation-in-part of U.S. patent application Ser. No. 10/566,536, filed Jan. 30, 2006, which claims priority to International Application No. PCT/IB2004/002298, filed Jul. 15, 2004, which are incorporated herein by reference in their entirety.

BACKGROUND

1. Field

The current disclosure relates to a unique and compact self-lock glazing system composed of two aluminum extrusion profiles—a male profile and a female profile—designed in such a way to self-lock glass panels using beadings. The mechanism functions when a glass panel is positioned on setting blocks over the flat surface of the upper leg of the said female profile—with spacers between the vertical leg of the said female profile and the said glass panel (as illustrated in FIGS. 3, 4, 5, 6, 7, 8) and the said male profile with the locking tip facing upward on its horizontal leg inserted into the gap between the upper leg and the lower leg of the said female profile against the female locking tip above. The locking tips of both male and female profiles are then engaged by tilting the vertical leg 30 of the said male profile outward about its built-in fulcrum, and inserting wedges into the space so created between the said glass panel and the vertical leg of the male profile, for keeping the said glass panel locked in position. The mechanism further tightens grip on the edges of the said glass panel when the said spacers and wedges are replaced by rubber beadings of appropriate resilience (which, for a glazing, avoids touching metal, to allow expansion and to absorb impacts).

In one example, the system may include locking beads or a locking bead profile that cause the male and female profiles, typically made of metal, to engage and self-lock. The introduction of the locking bead profile lends a unique dynamism to the mechanism. The tensile nature of the vertical legs causes a mating action in the locking chamber and the resulting equal and opposite reactions keeps the locking bead profile in equilibrium between the horizontal tips of both the male and female profiles by means of the built-in fulcrum. This balancing act of forces remains in the locking system throughout the life of the system.

2. General Background

U.S. Pat. No. 5,007,221 entitled "snap-in glazing pocket filler" disclosed a snap-in pocket filler for use with a structural frame member having an unused glazing pocket, or for use as gap filler on aluminum profiles to cover the unused area for aesthetic reason.

It was noticed that a proper glazing system was lacking in the market to meet the increasing demand for thicker glazing (e.g. shop fronts and partitions) and it has become a necessity for those skilled in the art to develop a system which must be simple, technically safe and aesthetically impressive.

The following U.S. patents are incorporated herein by reference:

TABLE

| PATENT NO. | TITLE | ISSUE DATE |
|---|---|---|
| 3,774,363 | Glazing Window or Windscreen Openings, Particularly in Vehicle Bodies | Nov. 27, 1973 |
| 3,881,290 | Glazed Impervious Sheet Assembly and Method of Glazing | May 6, 1975 |
| 4,689,933 | Thermally Insulated Window Sash Construction for a Casement Window | Sept. 1, 1987 |
| DE2614803 | GLASFALZLEISTE | Oct. 27, 1977 |
| JP10184208 | Filling to Which Glass and the Like can be Easily Attached/Detached | Jul. 14, 1998 |
| JP11256942 | Glazing Gasket | Sept. 21, 1999 |
| UK2237600 | Preventing Removal of Glazing Bead | May 8, 1991 |

In addition, in the construction industry and in other industries it is generally desirable to have a high strength-weight ratio load-bearing material for supporting loads over extended lengths. For instance, I-beams are commonly used as support structures in construction and civil engineering. Typically, I-beams are oriented such that flanges are maintained horizontally, while a web between the flanges is in a vertical orientation. In such fashion, gravitational loads along the length of the I-beam are oriented about the maximum moment of inertia, providing an efficient design for both bending and shear loads in the plane of the web. In a transverse orientation, for instance in an orientation where the flanges themselves are oriented in a vertical direction, loads are transverse to the flanges and an I-beam in this orientation is not an efficient support structure.

In general the moment of inertia is based on a distance that material is located from its neutral axis. As commonly known, the neutral axis is an axis in the cross section of a beam (a member resisting bending) or shaft along which there are no longitudinal stresses or strains. Thus, when oriented such that the flanges bear the load, because the flanges of an I-beam are located distant from the neutral axis the flanges provide an efficient structural design.

However, I-beams are not only costly to build but they are also costly to transport to construction sites, and bulky to work with at construction sites. For instance, in construction of a skyscraper, I-beams may be transported to very high sections of a building and may be difficult to move about and position during such construction. One reason for such inconvenience is because the I-beams are constructed to span great lengths, and they therefore are bulky to transport and install in their final end-use location. Thus, although I-beams have long provided a capability to support tremendous loads in an efficient fashion in construction and other engineering activities, their use includes the setbacks that include costly construction and costly transportation and assembly challenges. As such, there is a need for an improved construction support design that is less expensive and more convenient to fabricate, transport, and install.

BRIEF SUMMARY

Aluminum glazing profiles generally available in the market are intended for standard window glazing only. These profiles are used by many people for bigger partition walls with thicker glazing, compromising safety, quality and aesthetic appeal as no other options are available for glazing big partition walls with thicker glass panel than window pane glasses. For maximum visibility of the showrooms, designers insist on frameless glazing with thin frames around the glass panel. Technicians use U channels, in which glass panels are allowed to stand free but these tend to move horizontally due to loose fixing with silicone at the ends.

Some professional pioneers like Dorma (Germany) developed heavy profiles for thicker glass application which require fastening by screws that further should be covered for aesthetic reasons and consequently the work becomes complicated, laborious and eventually expensive. In view of the above factors and considering the demand for faster glazing, the current disclosure emphasizes the issue of safety while addressing the importance of aesthetic appeal, allowing enough clearance for glazing (so that one could decide the glass size before installing frames at site) and making site installation easy.

BRIEF DESCRIPTION OF THE SEVERAL VIEWS OF THE DRAWINGS

For a further understanding of the nature, objects, and advantages of the present disclosure, reference should be had to the following detailed description, read in conjunction with the following drawings, wherein like reference numerals denote like elements and wherein:

FIG. 14A illustrates a female profile;

FIG. 14B illustrates a male profile;

FIG. 14C illustrates a packing material;

FIG. 14D illustrates a rubber separator;

FIG. 14E illustrates a tapered or trapezoidal bar;

FIG. 14F illustrates a cladding material;

FIG. 14G illustrates a cladding or clip;

DETAILED DESCRIPTION

Figures 1A, 2A, 3, 4, 5, 6A, 7A:
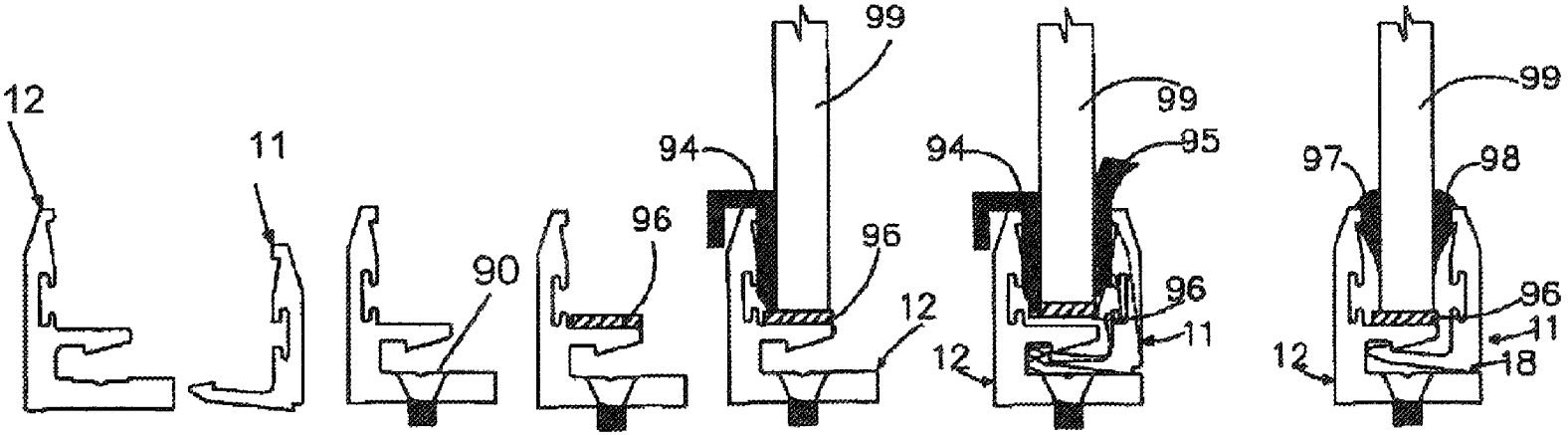
FIG. 1A is a female profile.
FIG. 2A is a male profile.
FIG. 3 is a structural fixing of the female profile using a screw.
FIG. 4 is glass packing on the female profile (minimum 2 per glass panel)
FIG. 5 is a glass panel (suitable to the frame size) placed over the female profile.
FIG. 6A is the horizontal leg of the male profile introduced through the gap between the upper leg and the lower leg of the female profile and the vertical leg of the male profile is tilted outward on its built-in fulcrum to engage the lock, then wedges are introduced to keep the lock engaged so that glass panel is locked in position.
FIG. 7A is a view of grooved rubber beadings which are introduced in between the gaps of profiles from both sides of the glass panel.
Figure 8:
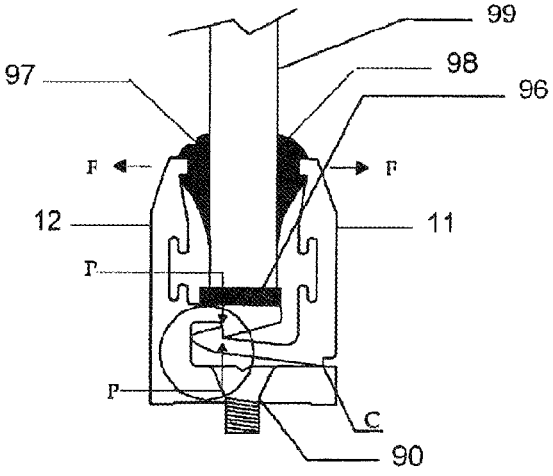
FIG. 8 is a side view of the mechanism of the glazing system.
Figure 9:
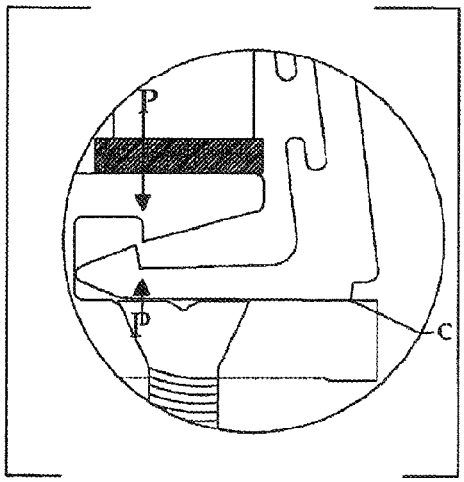
FIG. 9 are details of the locking tips of FIG. 8.

The self-lock glazing system includes two extruded aluminum profiles, a male profile 11, FIG. 2A and a female profile 12, FIG. 1A as described in the succeeding paragraphs, designed in such a way to create a secure space for keeping glass panels safely and tightly in position. An important aspect is that when a glass panel 99, FIG. 7A is placed on the upper leg 70 of the female profile 12 and the male profile 11 is inserted and rubber beadings 97, 98 are forced in (by hand) between the said glass panel 99 and the profiles 12, 11 respectively creates outward forces F, FIG. 8 on the vertical tips of the said profiles (forcing them apart). The turning moment at the pivotal fulcrum 18 of the said male profile 11 forces the locking system together because of the complementary locking tips 73 and 71 provided on the profiles as a result, the system interlocks and thus arrest the profiles (11 and 12) in position; eventually the said glass panel 99 held in guard (under the pressure of the beadings 98 and 97) of the said vertical tips (32, FIGS. 2B and 67, FIG. 1B) remains locked.

Figure 1B:
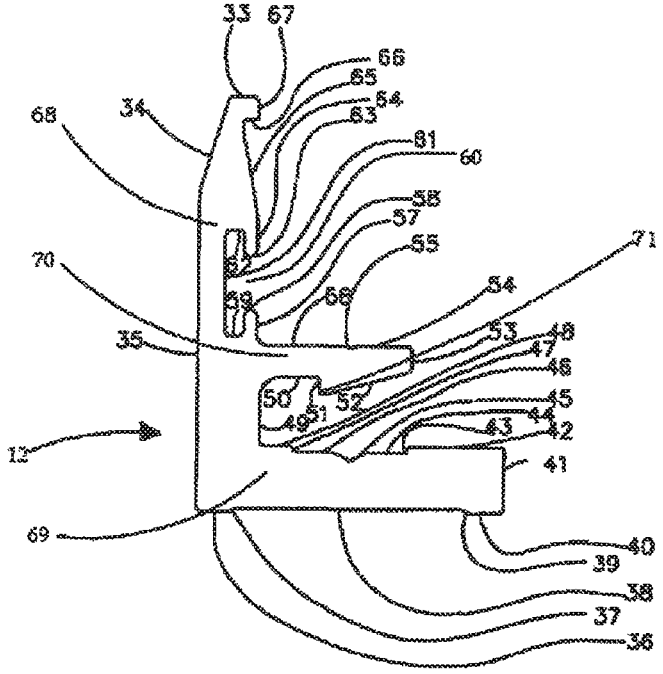
FIG. 1B is a female profile with reference characters.

The self-lock glazing system comprising:

a) A female profile 12, FIG. 1B, the female profile 12 is a right angled profile having a lower leg 69 as base, an upper leg 70 and an upward vertical leg 68. The upper leg 70 is the horizontal cantilever extension from the lower half portion of the vertical leg 68.

The vertical leg 68 originates from the horizontal lower leg 69 at the base and has a vertical face 35 which ends at about three-fourth the height of the vertical leg 68 to join an inclined surface 34 which terminates at the horizontal tip 33 with adjoining vertical face 67. The vertical face 67 acts as the link for transfer of forces between the glass panel 99, FIG. 5 and the female profile 12 and also helps to retain the rubber beading. The vertical face 67 is followed by a horizontal face 66 below that ends to a sloping face 65 which leads to the inside wall 64 of the vertical leg 68 that extends down to form a groove 60.

The said groove 60 comprises an upper projection 63, an upper recess 62, followed by the vertical wall 61 which is parallel to the exterior wall 35, a lower recess 59 and a bottom projection 58. The bottom projection 58 is followed by another vertical face 57 that curves down to join the upper face 56 of the upper leg 70.

The upper leg 70 which is the horizontal cantilever extension from the lower half portion of the vertical leg 68, has an upper flat surface formed by 56 and 54 and a groove 55 in between, and this leg 70 terminates approximately at two-thirds of the length of the lower leg 69 at tip 53 and its bottom has a downwardly sloping protrusion 52 with a female locking tip 71 with a mating face 51 followed by an upper horizontal surface 50 that curves down to the vertical wall 49 to form the locking chamber facing downward to the gap formed by the remaining portion of the inside wall 49 and the adjacent upper surface 48 up to 42 of the lower leg 69; this gap provides access to the said locking chamber.

The said vertical faces 67, 64, 57 and 49 are all in a same straight line and defines the inside wall of the said female profile 12. The recess formed by the sloped face 65 is for accommodating the allowances provided in the grooved rubber beadings.

The top surface of the lower leg 69 is flat in general, and this top surface starts with a horizontal surface 48 adjacent to the inner vertical wall 49 and this horizontal surface 48 defines the general level of the top surface. On the other end of the leg there is another horizontal surface 42 which is of same level as 48. The horizontal surface 42 at the other end plays a vital role in the system since it acts as the base for acting the built-in fulcrum 18 in the said male profile 11. The upper surfaces 48 and 42 of the lower leg 69 have two lower horizontal faces 46 and 44 in between with a 'v'-shaped groove 45 at its center. The recessed surface 46 is connected to the surface 48 with an inclined surface 47. The horizontal recessed surface 44 is connected with the surface 42 by an inclined surface 43. The 'v'-shaped groove 45 at the center acts as a guidance for drilling holes for countersunk screws 90 for fastening the female profile 12 to the structure. There is another 'v'-shaped groove 55 on the flat surface on top of the upper leg 70 that facilitates ease of drilling a hole for access to the 'v' shaped groove 45 vertically below. The 'v'-shaped grooves 45 and 55 are required to ensure precision and accuracy of the installation of the glazing system and also to make drilling easier and to the point.

Figure 2B:
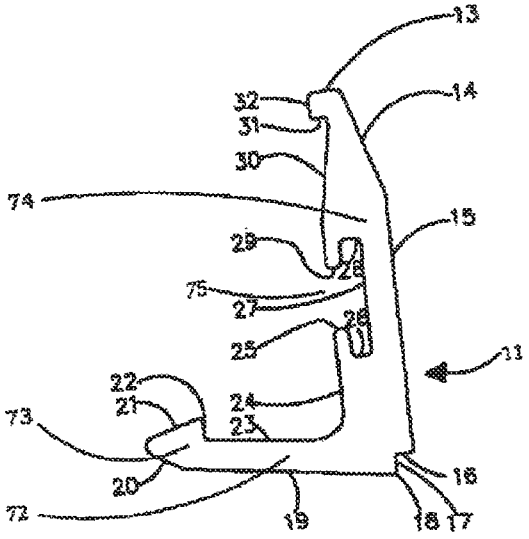
FIG. 2B is a male profile with reference characters.
Figure 6B:
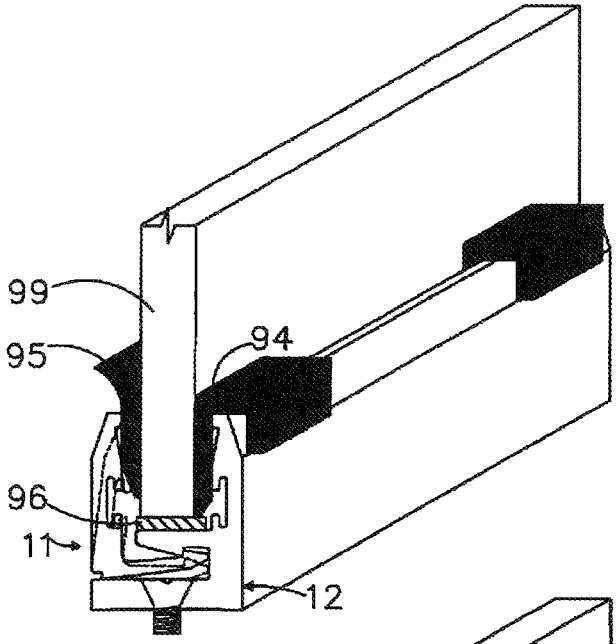
FIG. 6B is a perspective view of the self-lock glazing system showing the spacers.
Figure 6C:
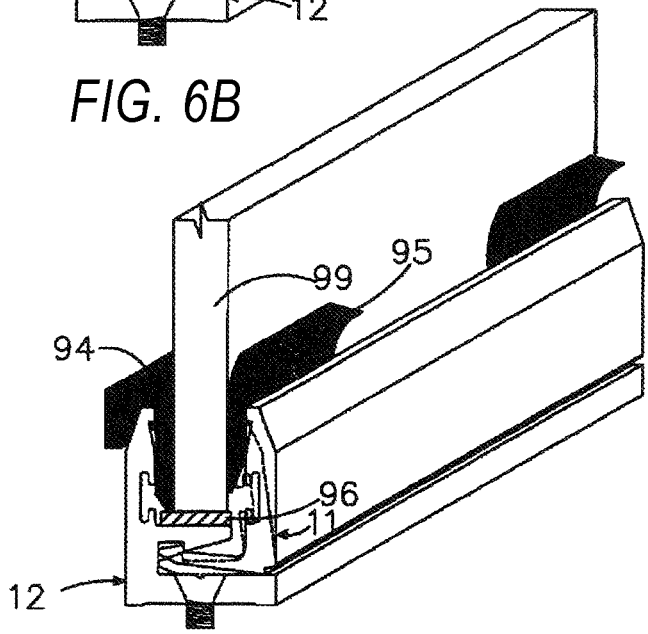
FIG. 6C is a perspective view of the self-lock glazing system showing the wedges.
Figure 7B:
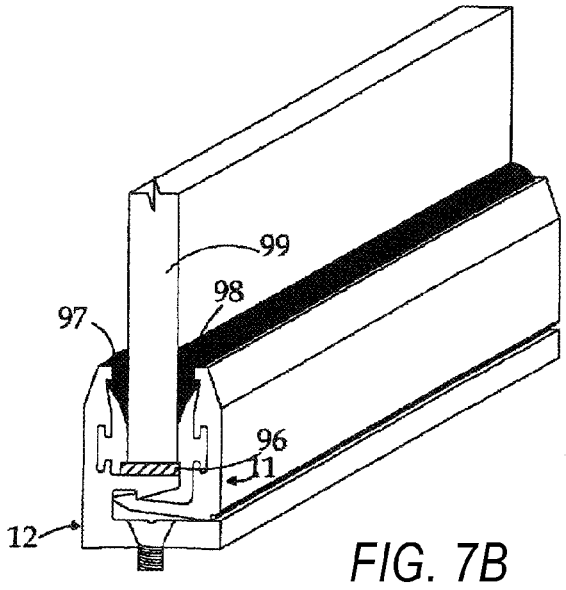
FIG. 7B is a perspective view of the self-lock glazing system with glass panel in position and the rubber beadings are introduced.

Adjacent to the horizontal surface 42, a vertical face 41 goes down to the bottom surface of the horizontal leg 69 and this vertical surface 41 comes in the same line with the outer surface 15 of the said male profile 11 when the system is engaged. The bottom surface of the lower leg of the said female profile 12 has two symmetrical projections 36 and 40 at the ends with recess 38 at center for proper seating. The recess 38 is connected to projection 36 and 40 with inclined surfaces 37 and 39 respectively.

b) A male profile 11, FIG. 2B, the male profile 11 is an acute angled profile that includes a horizontal leg 72 with a locking tip 73 at one end and vertical leg 74 at the other end. The horizontal leg 72 is the base with a lower surface 19 starting from the lower face 20 of the locking tip 73, and ends with the built-in fulcrum 18 with an adjoining recess formed by vertical face 17 and a horizontal face 16. The vertical leg 74 starts from the said recess with a surface 15 inclined forward, and ends at another inclined face 14 which is further inclined inward to join the horizontal tip 13.

The locking tip 73 comprising an upward sloping surface 20 turns to form another upward sloping surface 21, and an adjoining dropping down face 22 combines to form a unique shape to the locking tip 73. The upper surface 23 of the horizontal leg 72 curves upward to join the inner vertical wall 24 which extends up to a groove 75.

The said groove comprising a lower projection 25, an upper projection 29, a lower recess 26, an upper recess 28 with a vertical wall 27 that is parallel to the exterior wall 15, a top projection 29, joins the interior wall which slopes upward forming an inclined surface 30 which terminates at the horizontal surface 31. The horizontal surface 31 ends to a vertical face 32 that joins the horizontal tip 13.

The horizontal tip 13 together with a vertical surface 32 and a bottom surface 31 helps to retain the rubber beadings.

The mechanism functions when a glass panel 99 is positioned on packing 96 over the upper leg 70 of the said female profile with spacers 94 between the vertical leg 68 of the said female profile 12 and the said glass panel 99, and then inserting the horizontal leg 72 of the said male profile 11 with its locking tip 73 facing upward into the gap between the lower leg 69 and upper legs 70 of the said female profile, then engaging the locking tips of both male and female profiles by tilting the said male profile 11 on its built-in fulcrum 18 by pulling the vertical leg 74 outward and introducing the wedges 95 into the space so created between the said glass panel 99 and the said vertical tip 32 of the said male profile 11 to keep the locks engaged and thus the said glass panel 99 locked in the system; the mechanism further tightens its grip on the edges of the locked glass panel 99 when the spacers 94 and wedges 95 are replaced by rubber beadings 97 and 98 of appropriate resilience which enables the said glass panel 99 to remain in an equilibrium throughout the life of the beading. The vertical plane passing through the center of the glass panel 99 will intersect both the male profile 11 and female profile 12, and also intersect the gap of the female profile 12 and the leg 72 of the male profile 11. Then the horizontal tip 33 of the vertical leg 68 of the said female profile 12 and the horizontal tip 13 of the vertical leg 74 of the said male profile 11 are located at the same height when the glass panel 99 is positioned and the lock is engaged by tilting the said male profile 11 on its built-in fulcrum 18 by pulling the vertical leg 74 outward and introducing the wedges 95 into the space so created between the said glass panel 99 and the said vertical tip 32 of the said male profile 11 to keep the locks engaged and thus the said glass panel 99 locked in the system.

METHOD OF INDUSTRIAL APPLICATION

The scientific principles used are the Newton's Law of Motion, the property of elasticity of the rubber and the transmission of the rotational moments of the moving parts around the fulcrum. The following explanation is read in relation to FIG. 8:

F-Outward force (due to the resilience of rubber beading)

P-Inward force (creating the locking)

C-Fulcrum point

Insertion of the rubber between the glass panel and the upper tips of the vertical legs of profiles creates outward forces (F) to the legs of both profiles forcing them apart.

A turning moment at the pivotal fulcrum (C) forces the locking system together (P). The locking system functions due to the combination of a pair of hooking tips and the fulcrum built in the legs of the male and female profiles mating in the locking chamber while retaining the pivotal mating profile (male) firmly in position and the glass panel which is under the grip of the said vertical tips are eventually remain locked.

The pre-determined variables are the sizing of the glass panel and that of the rubber beading. In this arrangement any external forces applied due to conditions like wind or vibrations caused by physical movements—whose action may act to dislodge the glass from its set position—only acts to further tighten the fastening mechanism of the system to arrest the glass panel in position.

Figure 10A:
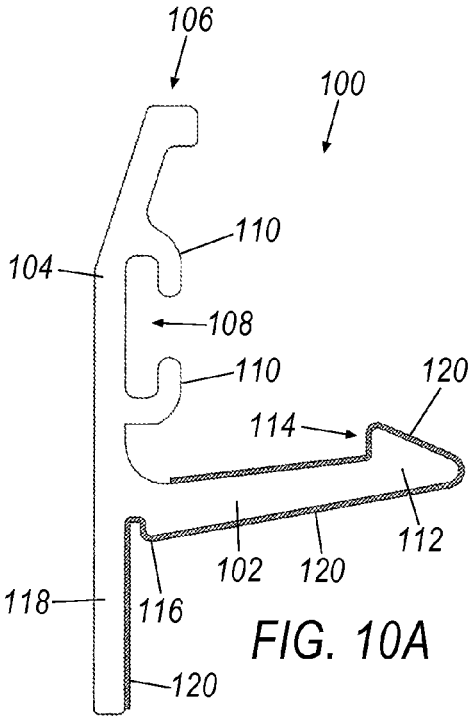
FIG. 10A includes a male profile having a thermal break material.

FIG. 10A illustrates a male profile 100 having a male profile leg or locking extension 102, and a leg 104 extending therefrom and having a tip 106. Leg 104 includes a cavity section 108 that is formed in part by clip segments 110. Locking extension 102 includes a locking or engagement tip 112 having a locking face 114 that engages male profile 100 in an assembly, as will be described. A fulcrum 116 is formed as part of locking extension 102 that is proximate where locking extension 102 is attached to leg 104. An additional cover or leg 118 extends from leg 104 that, in one example, is included to provide an improved aesthetic design to an overall assembly of components by providing a generally uninterrupted visible exterior. In the illustrated example, male profile 100 includes a thermal break material 120 that covers at least a portion of male profile 100, such as locking extension 102 and additional leg 118.

Figure 10B:
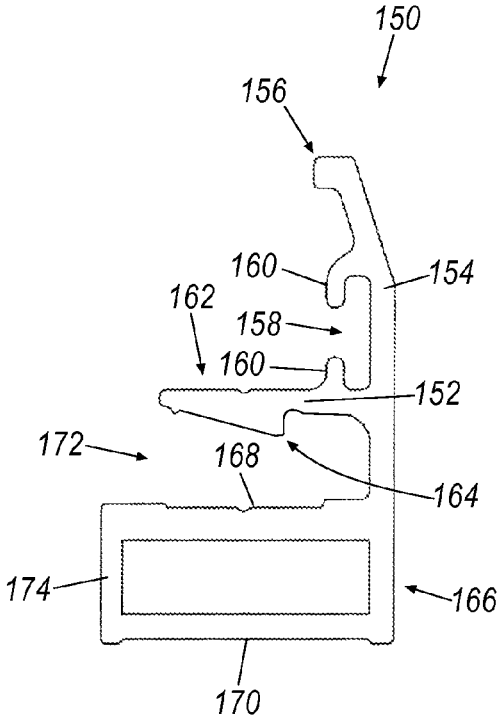
FIG. 10B includes a female profile configured to engage with the male profile of FIG. 10A.

FIG. 10B includes a female profile 150 configured to engage with male profile 100 of FIG. 10A. Female profile 150 includes an upper leg or locking extension 152 and a leg 154 extending therefrom, leg 154 having a tip 156. Leg 154 includes a cavity section 158 formed in part by clip segments 160. Locking extension 152 includes a locking or engagement tip 162 having a locking tip or face 164 that engages in an assembly that includes male profile 100. Female profile 150 includes a base structure 166 having an upper surface 168 and a lower surface 170. A gap 172 is formed between upper surface 168 of base structure 166 and locking extension 152.

Figure 11:
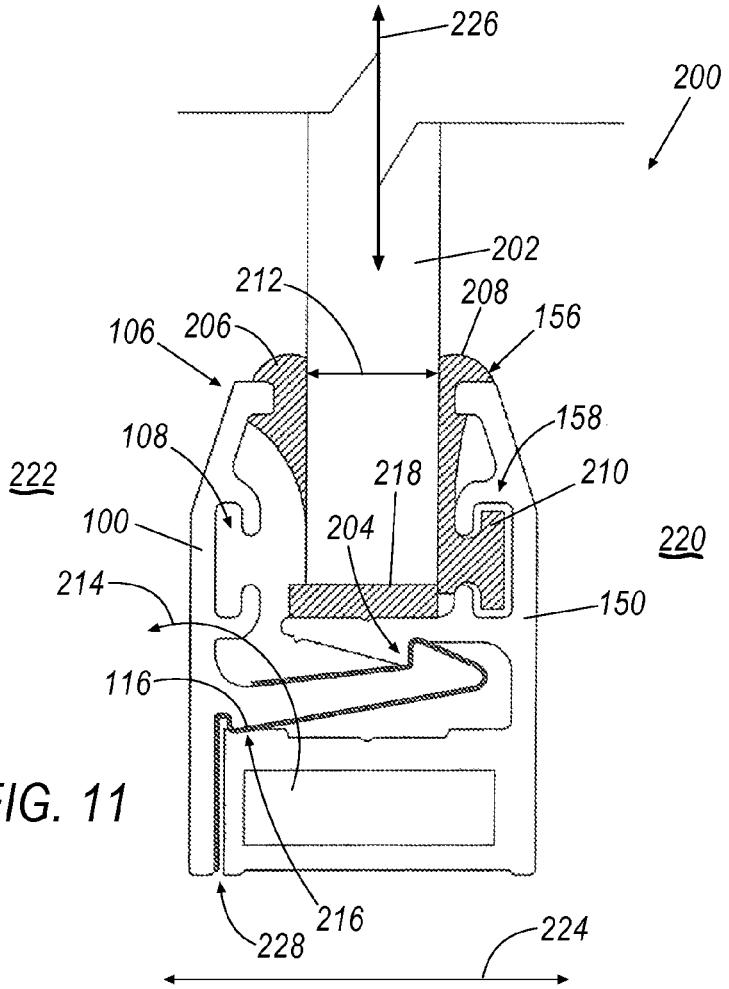
FIG. 11 illustrates a glazing assembly having engaged male and female profiles.

FIG. 11 illustrates a glazing assembly 200 having male profile 100 engaged with female profile 150. A panel or window 202 is positioned between tip 106 of male profile 100, and tip 156 of female profile 150 that, in the illustrated example, are approximately opposite one another. As shown, male profile 100 engages with female profile 150 at an engagement or contact location 204, which is defined by an interface region between locking face 114 of male profile 100, and locking face 164 of female profile 150.

A bead 206 is positioned between tip 106 and panel 202, and a bead 208 is positioned between tip 156 and panel 202. In the illustrated example, bead 208 includes an extension or capture material 210 that is positioned within cavity section 158. As such, bead 208 is captured or coupled to female profile 150, and may be captured thereto even without the presence of panel 202. Bead 206, on the other hand is illustrated as captured between tip 106 and panel 202 but does not extend into cavity section 108, as does material 210 of bead 208. However, it is contemplated that either or both of beads 206, 208 may include a material such as material 210 that is fit into and captured by respective cavity sections 108 and 158.

Beads 206 and 208 are fabricated from an elastically compressible and resilient material such as a rubber-type compound. Accordingly, each is installed into assembly 200 such that an outward force 212 results from compression that is applied against each of beads 206, 208. Force 212 thereby causes tips 106, 156 to force apart from one another. As such, male profile 100 is caused to rock or rotate 214 and about fulcrum 116, which abuts against a point or contact location 216 of female profile 150. Contact location 216, as illustrated, is on upper surface 168 of base structure 166. Accordingly, the rocking 214 about fulcrum 116 causes a locking engagement at engagement location 204 and between locking face 164 of female profile 150, and locking face 114 of male profile 100. That is, panel 202 is positioned between the first and second tips 106, 156, and outward forces 212 cause female and male profiles 150, 100 to engage by tilting leg 104 outward from panel 202 and about fulcrum 116. In one example, panel 202 is positioned on a base material or packing 218, that may provide dampening (to avoid shock to panel 202) to reduce damage to panel 202 during installation and use.

As can be appreciated, typically a window or panel 202 serves not only as a wind break in a structure (such as a residence or other building), but also to reduce an amount of heat transfer between both sides of the assembly. For instance, in one example, assembly 200 may be positioned to reduce the amount of heat transfer between an outside area 220 and an inside area 222. In this example, outside area 220 may be very cold, such as during winter in a cold climate, and may be at a temperature of −10° C., in an example. Inside area 222, on the other hand, may be at room temperature of 22° C., for example. Thus a temperature differential of 33° C. exists, in this example.

In another example, the direction of heat transfer may be reversed, such as may occur in summer months or in a very hot climate. For instance, in one example, assembly 200 may be positioned to reduce the amount of heat transfer between an inside area 222 and an outside area 220. In this example, outside area 220 may be very warm, and may be at a temperature of 42° C., in an example. Inside area 222, on the other hand, may be at room temperature of 22° C., for example. Thus a temperature differential of 20° C. exists, in this example.

As such, heat may transfer in a direction 224 that is generally orthogonal or transverse to a main axis 226 of panel 202, the direction of which is dependent on relative temperatures between one side of the assembly and the other. Thus, heat may transfer orthogonally through panel 202 and also through other components of assembly 200. As can be seen in assembly 200, conduction heat transfer from male profile 100 to female profile 150 occurs through beads 206, 208 (and panel 202), and also through locations or areas of direct contact therebetween. That is, engagement area 204 is one location where conduction occurs, and contact location 216 is another location where conduction occurs. Conduction heat transfer is relatively limited between beads 206, 208 and panel 202 because beads 206, 208 because the resilient material of beads 206, 208 is generally quite low (such as below 2 W/m-K). Thus, contact location 204 and contact location 216 represent at least two locations in assembly 200 that may have an increased propensity to conduction heat transfer.

As such and as described, thermal break material 120 is positioned between female profile 150 and male profile 100, and in one example material 120 covers at least a portion of male profile 100. In such fashion, an amount of conduction heat transfer is reduced between male profile 100 and female profile 150 because thermal break material 120 causes an interruption in the heat transfer path between inside area 222 and outside area 220. To reduce the amount of heat transfer, thermal break material 120 has a thermal conductivity that is lower than materials of male profile 100 and female profile 150. In examples, thermal break material is ABS or polycarbonate, or other material such as plastic. Plastic may include a synthetic material from a wide range of organic polymers such as polyethylene, PVC, nylon, etc., that can be molded into shape while soft and then set into a rigid or slightly elastic form. In general, the thermal break material typically has a low thermal conductivity relative to metals. For instance, profiles 100, 150 may be made of aluminum or other metal that may have a thermal conductivity greater than 100 W/m-K. Plastic, on the other hand, typically is below 2 W/m-K.

In one example, thermal break material 120 is attached directly to the male profile 100. That is, thermal break material 120 may be thermally bonded directly to male profile 100 in at least the areas of contact between profiles 100, 150, such as contact location 204 and contact location 216. In another example, thermal break material 120 is an extra item that is not directly bonded to male profile 100, but instead added to male profile 100 during assembly. Regardless, as shown, thermal break material 120 may be included over areas of male profile 100 in addition to contact location 204 and contact location 216, to ensure that any inadvertent contact between profiles 100, 150 will not be direct between the materials of each of profiles 100, 150 once assembled into assembly 200.

For instance, assembly 200 includes a gap 228 between additional leg 118 of male profile 100, and a face 174 of base structure 166. Gap 228 may be generally less than 1 mm in thickness and in one example, is 0.25 mm. As stated, additional leg 118 provides a generally uninterrupted exterior surface for male profile 100 that extends along face 174, for aesthetic purposes. As such and as a few examples, component tolerances, component distortion during assembly (components may be damaged or plastically deformed), and component distortion during use (such as in heavy wind or by pressure being placed by objects placed against assembly 200), may cause additional leg 118 to come into contact with face 174. Thus, thermal break material 120 may be included on additional leg 118, and in other portions of male profile 100 that may come into contact with female profile 150 after the assembly 200 is formed. Accordingly, the total amount of heat transfer between inside area 222 and outside area 220 is reduced, when compared to such an assembly that does not include thermal break material 120.

Self-locking glazing system or assembly 200 is fabricated, in one example, by engaging locking extension 102 of male profile 100 with locking extension 152 of female profile 150, positioning thermal break material 120 between the male and female profiles 100, 150, and positioning panel 202 using beads 206, 208 between tips of the male and female profiles 106, 156 to engage male and female profiles 100, 150 against thermal break material 120.

Figure 12:
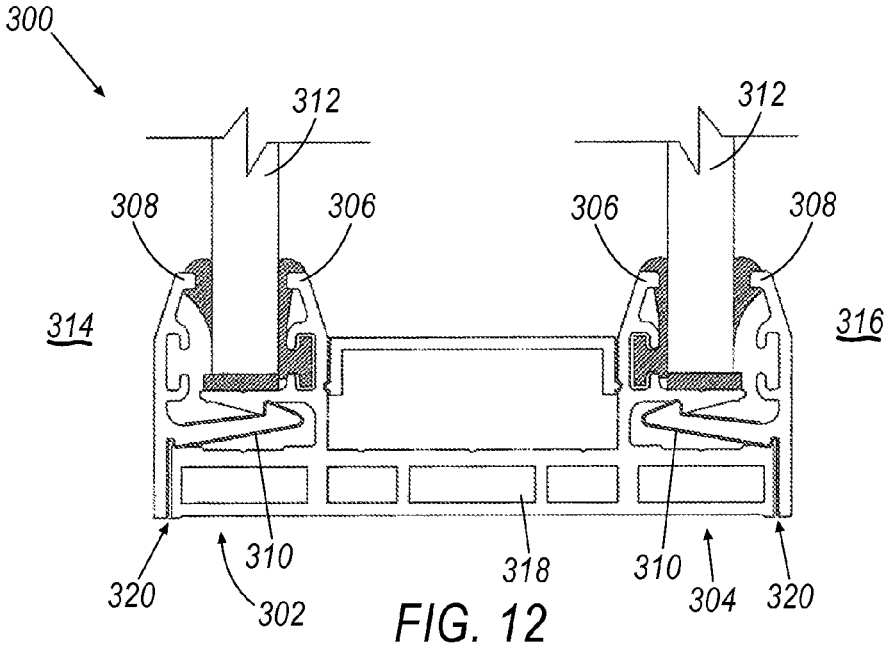
FIG. 12 illustrates a self-locking glazing system having two assemblies.

Referring to FIG. 12, a self-locking glazing system 300 may include two assemblies as previously disclosed, such as assembly 200. System 300 may include a first assembly 302 and a second assembly 304, each of which includes generally the features as described above with respect to assembly 200. That is, each assembly 302, 304 may include a respective female profile 306, male profile 308, and thermal break material 310 positioned therebetween. When respective panels 312 are positioned as described above and between tips in each assembly, the male and female profiles are caused to engage against the thermal break materials 310. As such, an amount of heat transfer between an inside area 314 and an outside area 316 is reduced still further because of the additional thermal barrier provided and the respective thermal break materials 310.

In one example, system 300 includes a common base 318 that forms both female profiles 306. Accordingly, gaps 320 are formed between each male profile 308 and common base 318. As such, thermal break materials 310 may extend on each male profile 308 such that any inadvertent contact in the gaps 320 is first met with a thermally resistive material. Female profiles 306 each further comprises a respective base structure having an upper surface and a lower surface, such that gaps are formed between each of the respective upper surface and the locking extension of the female profiles 306. A fulcrum is formed in each of the male profiles, where each locking extension extends from a respective leg, and each locking extension extends into a respective gap. Each fulcrum forms a contact location with the upper surface of the respective base structure where the respective thermal break material is positioned between the female profile and the male profile.

Figure 13:
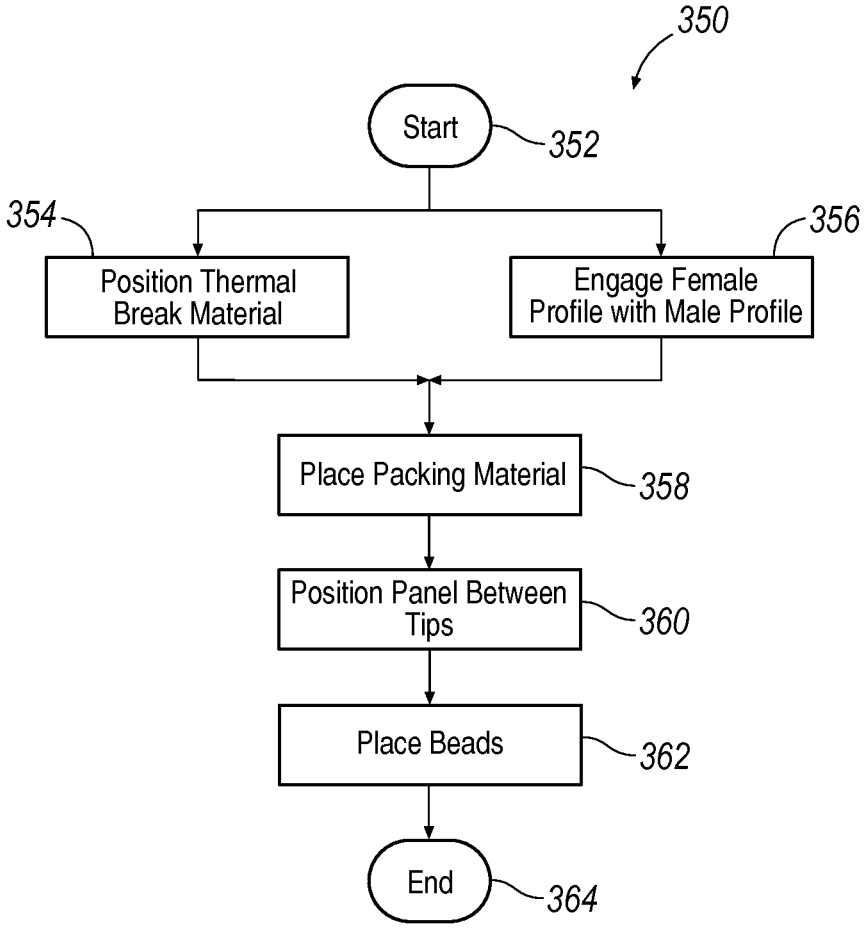
FIG. 13 illustrates a method of fabricating a glass handrail assembly.

FIG. 13 illustrates a method 350 of fabricating a self-locking glazing system. Starting at block 352, method 350 includes a block to position a thermal break material 354, and a block to engage the female profile with the male profile 356. Blocks 354 and 356 are illustrated in parallel with one another, but it is contemplated that actions in each block 354, 356 may be conducted in one order, or another order. That is, according to one example, the thermal break material, such as thermal break material 120 described above, may be affixed to locking extension 102 prior to engagement of the male and female profiles 100, 150. However, in another example, thermal break material 120 may be placed between the male and female profiles during the assembly process. For instance, in one example, thermal break material 120 is a relatively flexible material that is draped over locking extension 102 such that, when male profile 100 is engaged with female profile 150, the thermal break material 120 is pressed in and positioned therebetween and at the contact locations 204, 216. In such fashion, thermal break material 120 is positioned between profiles 100, 150 such that an amount of conduction heat transfer within assembly 200 is interrupted generally along direction 224. After engagement of profiles 100, 150 with thermal break material 120 positioned therebetween, at block 358, packing material such as base or packing material 218 is positioned on locking extension 152 of female profile 150. Panel 202 is positioned between tips 106, 156 at block 360. At block 362, beads 206, 208 are placed between panel 202 and respective tips 106, 156. In examples, one or both beads 206, 208 may be further retained by having a capture material, such as capture material 210 of bead 208, within cavity section 158. At block 364, assembly process 350 ends.

In operation, assembly 200 thereby tightens a hold on panel 202 when wind or other pressure is placed thereagainst. That is, as wind or pressure is brought to bear against panel 202 (generally orthogonally to main axis 226 but the direction may be in any vector against panel 202), the force causes slight motion against male profile 100, causing rotation about fulcrum 116, thereby causing engagement tip 112 of male profile 100 to further engage against engagement tip 162 of female profile 150. Thus, as external force is applied to the structure, the overall structure increases its grip on panel 202, resulting in the self-locking operation or mechanism.

Further, beads 206, 208 may further reduce an amount of heat transfer in assembly 200 by adding thermal resistance between tips 106, 156 and panel 202. As such, beads 206, 208 may be customized based on desired resiliency and based on mechanical engagement within assembly 200 (providing adequate reaction forces during operation) and/or based on a desired amount of thermal resistance. Further, beads 206, 208 may be modifiable such that other designs may be provided based on conditions of use. For instance, in a hot or dusty environment, it may be desirable for beads 206, 208 to also provide a dust barrier such that dust does not pass through the assembly and indoors.

As such, a self-locking glazing system includes a female profile having a first locking extension and a first leg extending therefrom, the first leg having a first tip. The system includes a male profile having a second locking extension and a second leg extending therefrom, the second leg having a second tip that is approximately opposite the first tip. A thermal break material is positioned between the female and male profiles. When a panel is positioned between the first and second tips using the beads 206, 208, the female profile and the male profile are caused to engage against the thermal break material.

The previously disclosed assemblies were described in applications useful for containing glass panels for applications such as for a window in a building. However, due to the ability of the assembly to grip the panel, and increase the grip when transverse forces are applied to the panel (due to the self-locking nature of the assembly), other uses may be considered as well. For instance, in one example a self-locking handrail assembly includes the disclosed panel as a handrail for, for instance, a stairwell or along an upper portion of a wall.

FIGS. 14A-14G illustrate components of a self-locking handrail assembly that may be incorporated into various exemplary designs. FIG. 14A includes a female profile 400 having a gap 402 formed between a lower leg 404 and an upper leg or locking extension 406 that are approximately parallel to one another. A vertical leg 408 extends from locking extension 406 approximately orthogonal thereto. Locking extension 406 includes a female locking or engagement tip 410. Female profile 400 includes a cutout 412 having a lip 414. Female profile 400 also includes a cutaway surface 416 having an indented region 418.

FIG. 14B illustrates a male profile 430 having a male profile leg or locking extension 432 and a vertical leg 434 extending therefrom. A fulcrum 436 is formed at the approximate intersection of locking extension 432 and vertical leg 434, and locking extension 432 extends from vertical leg 434, approximately orthogonal thereto. Locking extension 432 includes a male locking or engagement tip 438. Male profile 430 includes a cutout 440 having a lip 442. Vertical leg 434 includes a surface 444 having an indented region 446.

FIG. 14C illustrates a packing material 450 that is a relatively soft and compliant material, such as rubber having a range of 20-95 on the durometer A scale, as an example. However, other materials may apply as well for packing material 450, such as plastic and other materials. FIG. 14D illustrates a separator 460 that, in one example, is rubber having a range of 20-95 on the durometer A scale.

FIG. 14E illustrates a bar 470 having a first surface 472 and a second surface 474 that are tapered with respect to each other and not parallel with one another, forming a trapezoid in the illustrated example. That is bar 470 includes first and second surfaces 472, 474 that are opposite one another but are not parallel. Bar 470 is a hard material such as metal, and includes a hole 476. FIG. 14F illustrates a cladding material 480 that, in one example, is stainless steel. FIG. 14G illustrates a cladding or clip 490 having a first attachment region 492 and a second attachment region 494.

As will be illustrated, FIGS. 14A-14G illustrate components that may be used in different self-locking handrails assemblies, as will be further illustrated.

Figure 15:
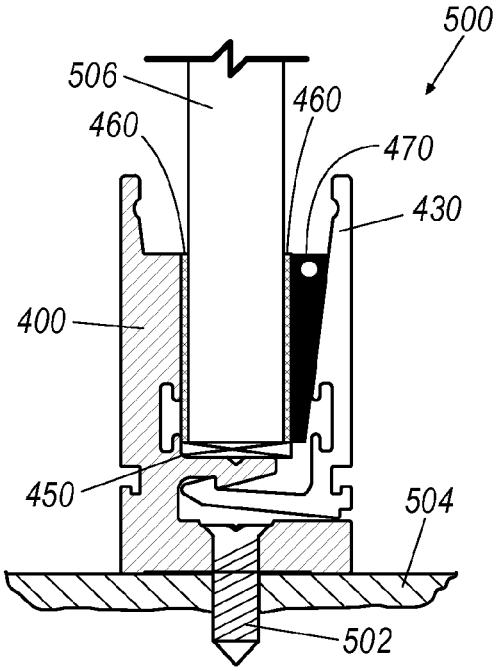
FIG. 15 illustrates a glass handrail assembly, according to one example.

Referring to FIG. 15, a glass handrail locking assembly 500 includes components illustrated in FIGS. 14A-14E. In assembly 500, female profile 400 is screwed via a screw 502 to a base material 504. Locking extension 432 of male profile 430 is positioned within gap 402, and profiles 400, 430 are engaged via female locking tip 410 and male locking tip 438. Packing 450 is positioned on an upper surface of locking extension 406. A glass handrail or panel 506 is positioned between vertical leg 408 and vertical leg 434. Separator 460 is positioned to both sides of panel 506, and bar 470 is positioned with its taper facing down or inward toward the assembly, such that its non-parallel surfaces 472, 474 wedge against male profile 430 and panel 506 (through rubber separator 460), causing female profile 400 and male profile 430 to engage by tilting vertical leg 430 outward from panel 506 and rotating about fulcrum 436 (resting on an upper surface of lower leg 404).

Bar 470 causes a mating action between female locking tip 410 and male locking tip 438, resulting in equal and opposite reactions that keep panel 506 in equilibrium between vertical leg 408 and vertical leg 434. Bar 470 includes hole 476 to provide an access location such that bar 470 may be removed from assembly 500 for disassembly or for replacing panel 506, as examples. That is, bar 470 is positioned between panel 506 and vertical leg 434, bar 470 having first and second surfaces 472, 474 opposite one another that are not parallel with one another, causing the female and male profiles 400, 430 to engage by tilting vertical leg 434 outward from panel 506 and about fulcrum 436. More specifically, because of the taper or non-parallel arrangement of surfaces 472, 474 of bar 470, male profile 430 is forced outward from panel 506 as bar 470 is pressed between panel 506 and vertical leg 434 of male profile 430, which causes male profile 430 to rotate about fulcrum 436 and tilt. Such tilting causes engagement of the profiles 400, 430 at their respective engagement tips 410, 438. Such engagement increases with increased insertion of bar 470, causing a self-locking action. The self-locking action increases yet further if external forces such as wind or other pressure are applied transversely to panel 506.

Figure 16:
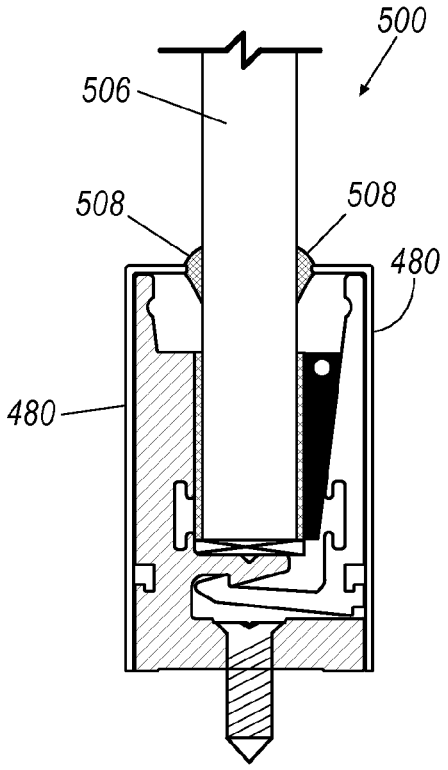
FIG. 16 illustrates a glass handrail assembly having a cladding material.

FIG. 16 illustrates a handrail assembly according to another example. Handrail assembly 500 of FIG. 15 includes, in this example, cladding material 480 of FIG. 14F that is attached to outer surfaces of assembly 500, the outer surfaces facing away from panel 506, to provide protection from the elements and to provide aesthetic improvement. In the illustrated example, each cladding material 480 is attached or coupled via a weather strip of silicon material, or beads 508 to respective sides or surfaces of panel 506. In one embodiment, the beads are a resilient material such as rubber.

Figure 17:
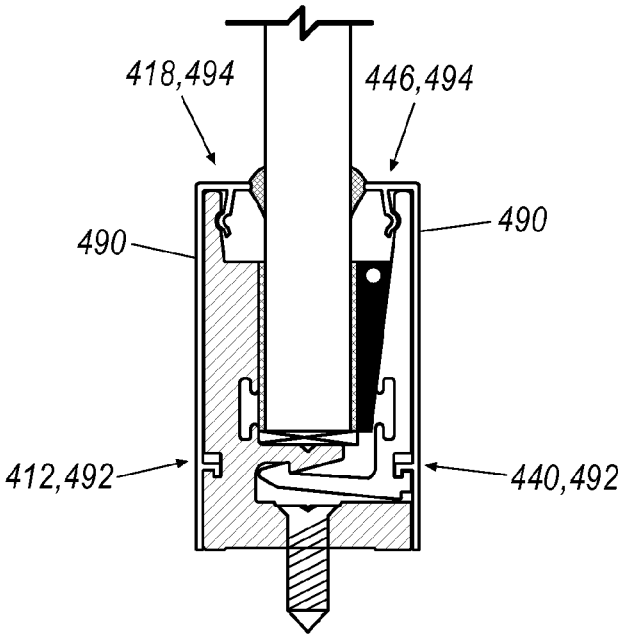
FIG. 17 illustrates a glass handrail assembly having a clip.

FIG. 17 illustrates a handrail assembly according to another example. Handrail assembly 500 of FIG. 15 includes, in this example, clip 490 of FIG. 14G that is retained to the assembly using first attachment region 492 that is attached to cutout 412 via lip 414, and another clip 490 is attached to cutout 440 via lip 442. Additionally, second attachment region 494 also attaches to cutaway surface 416 via indented region 418, and the other clip attaches via second attachment region 494 to surface 444 via indented region 446. That is, each of the claddings 490 is pressed against surfaces of the male profile and the female profile to retain them therein.

As such, a self-locking handrail system includes a female profile that includes a lower leg, a first locking extension that is approximately parallel to the lower leg, having a gap formed therebetween, and a first vertical leg extending from the first locking extension approximately orthogonal to the first locking extension. The system also includes a male profile that includes a second vertical leg, and a second locking extension extending from a free end of the second locking extension, forming a fulcrum. A panel is positioned between the first vertical leg and the second vertical leg. A bar is positioned between the panel and the second vertical leg, the bar having first and second surfaces opposite one another that are not parallel with one another, causing the female and male profiles to engage by tilting the second vertical leg outward from the panel and about the fulcrum.

Thus, in general, disclosed is a multi-tensioned composite profile (MTCP) or self-locking support system. The system includes a locking bead profile that remains in an equilibrium due to a dynamism inherent in the locking system caused by the tensile nature of the metal profiles (aluminum), the cantilever function of the locking extension (of the female profile), and the leverage mechanism provided in the system.

Furthermore, disclosed is a method of fabricating the glazing system. That is, a method of assembling the glazing system includes providing a female profile having a first leg, a first locking extension that is approximately parallel to the first leg, having a gap formed therebetween, the female profile including a first vertical leg that extends orthogonally from the first locking extension, and providing a male profile having a second vertical leg and a second locking extension that extends from a free end of the second vertical leg, forming a fulcrum. The method further includes positioning the second locking extension of the male profile within the gap of the female profile, positioning a panel between the first vertical leg and the second vertical leg, obtaining a bar having first and second surfaces opposite one another that are not parallel with one another, and positioning the first surface of the bar against the panel, and the second surface of the bar against the second vertical leg, causing the female and male profiles to engage by tilting the second vertical leg outward from the panel and about the fulcrum.

Figure 18A:
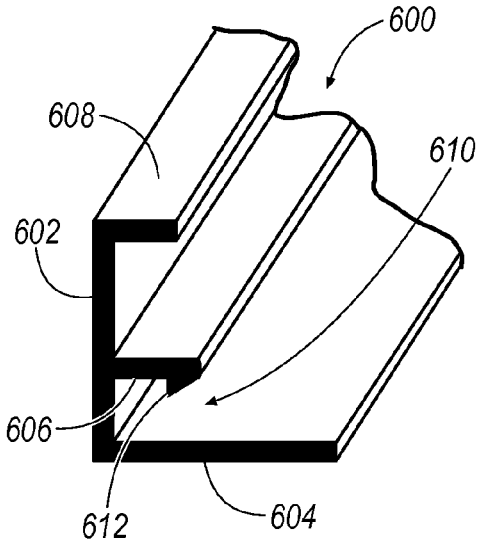
FIG. 18A illustrates a female profile for a self-locking support system.
Figure 18B:
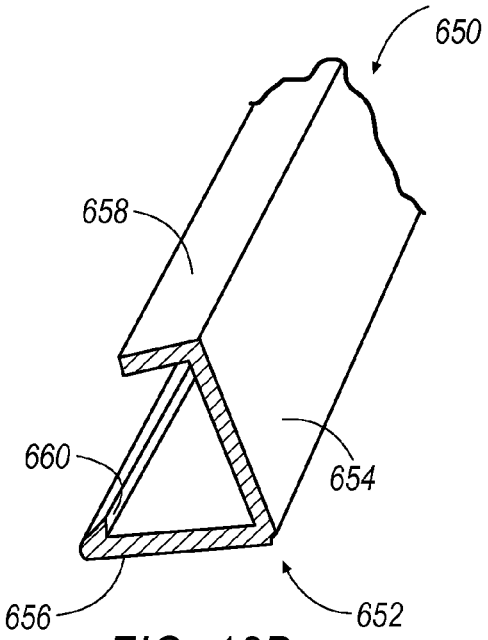
FIG. 18B illustrates a male profile for a self-locking support system.

A self-locking support system includes a female profile and a male profile, as illustrated respectively in FIGS. 18A and 18B. As will be further illustrated, the disclosed self-locking system extends in an axial direction and locking beads cause interlocking profiles to engage, providing a support structure that extends axially to support mechanical and gravitational loads over the axial length. And, although the exemplary embodiments in FIGS. 18A and 18B are illustrated and described having components that are approximately orthogonal to one another, it is contemplated that approximately orthogonal for these and all embodiments may include any angle plus or minus 90 degrees, such that the components engage as in the disclosed examples.

FIG. 18A shows a female profile 600 that includes a first vertical or profile leg 602 extending approximately orthogonally from a base 604, and a first locking leg 606 extending from first vertical leg 602. A first tip 608 extends approximately orthogonally from first vertical leg 602, in the illustrated example. A gap 610 is formed between base 604 and first locking leg 606, and an engagement face 612 extends downward from an end of first locking leg 606.

FIG. 18B shows a male profile 650 that includes a fulcrum 652 formed at an intersection of a second vertical or profile leg 654 and a second locking leg 656, the second vertical leg 654 having a second tip 658 extending therefrom approximately orthogonally, in the illustrated example. An engagement face 660 extends upward from an end of second locking leg 656.

Figure 19A:
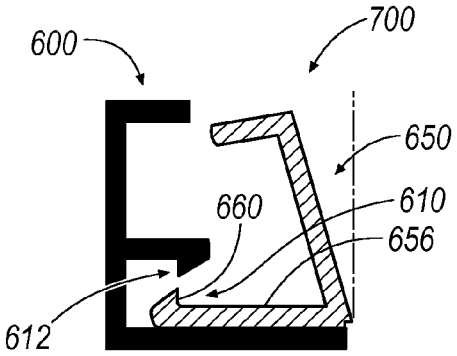
FIGS. 19A and 19B illustrate engagement of a self-locking support system.
Figure 19B:
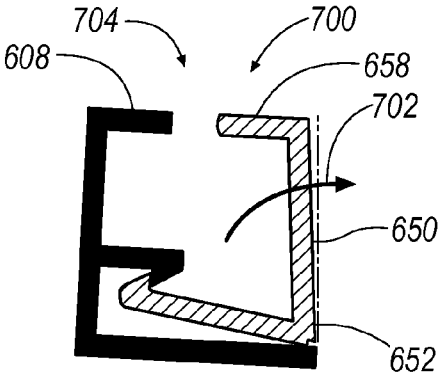

FIG. 19A shows a sub-assembly 700 of the self-locking support assembly. Second locking leg 656 of male profile 650 is inserted into gap 610 of female profile 600 and prior to engagement of engagement face 612 with engagement face 660. FIG. 19B shows rotation 702 of male profile 650 about fulcrum 652 at the point of engagement of faces 612, 660. A space or gap 704 is formed between tips 608 and 658, at the point when the components have not yet been forced together. That is, FIG. 19B shows sub-assembly 700 at the point of engagement, but the overall structure is further formed by positioning a locking bead in space 704 to force further separation of tips 608, 658.

Figure 20A:
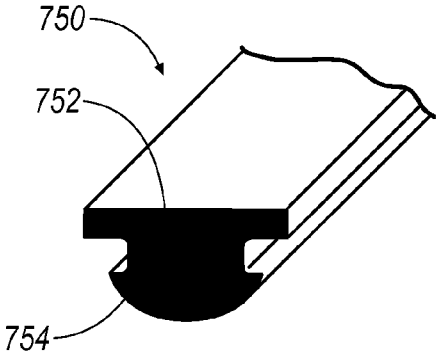
FIG. 20A illustrates a dome-shaped locking bead.
Figure 20B:
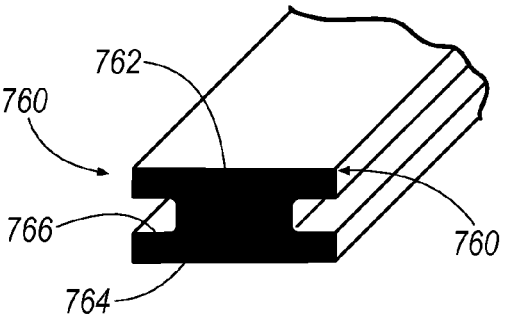
FIG. 20B illustrates a H-shaped locking bead.

As stated, separation of tips 608, 658, and further engagement of female profile 600 and male profile 650, is caused by positioning a locking bead in space 704. In one example, shown in FIG. 20A is a dome-shaped locking bead 750 having an upper surface 752 and a domed or semi-circular surface 754 that is pressed into space 704 of sub-assembly 700. In another example, shown in FIG. 20B, a locking bead 760 may be in the shape of an "H", having an upper surface 762 and a lower surface 764, each of which form clearances or gaps 766. In this example, locking bead 760 is slid in from an axial end of the assembly.

Figure 21A:
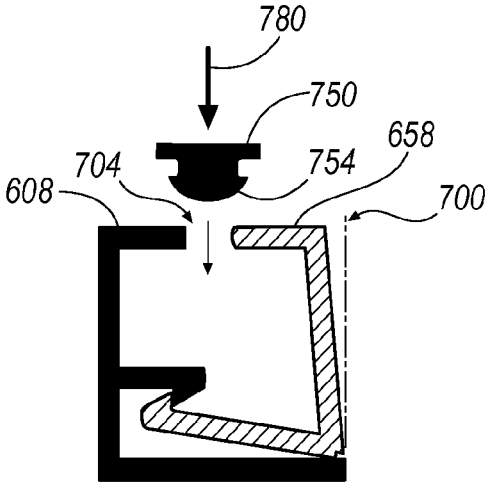
FIGS. 21A and 21B illustrate engagement of a self-locking support system.
Figure 21B:
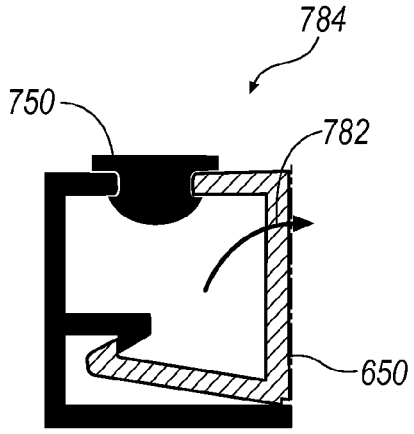

Referring to FIG. 21A, sub-assembly 700 is illustrated having dome-shaped locking bead 750 pressed in a downward direction 780 and into space 704. The domed surface 754 passes between and against tips 608, 658, forcing them apart and forcing male profile 650 to distort or elastically deflect 782, as shown in FIG. 21B. Having locking bead 750 positioned as such, places the overall assembly 784 in a state of pre-tension, such that assembly 784 may be moved and positioned at, for instance, a construction site or within a mechanical assembly. That is, the locking bead 750 forms a press-fit between tips 608, 658, causing opposing expansion forces to form outward from one another to lock the female profile and the male profiles against one another. As seen in FIG. 21A, profiles 600 and 650 are in their pre-stressed or relaxed form or position, and prior to tips 608, 658 being pressed apart. Upon insertion of the bead 750, profiles 600, 650 are forced into a stressed state, with tips 608, 658 being expanded apart from one another upon insertion of bead 750. In the uninstalled position prior to insertion of bead 750, the approximately vertical legs of each profile are angled slightly with respect to each other, but after insertion of the bead 750, the approximately vertical legs are approximately parallel to one another and in a stressed state. That is, the locking bead forms a press-fit between the first and second tips, causing opposing expansion forces to form outward from one another to lock the female profile and the male profiles against one another.

Figure 21C:
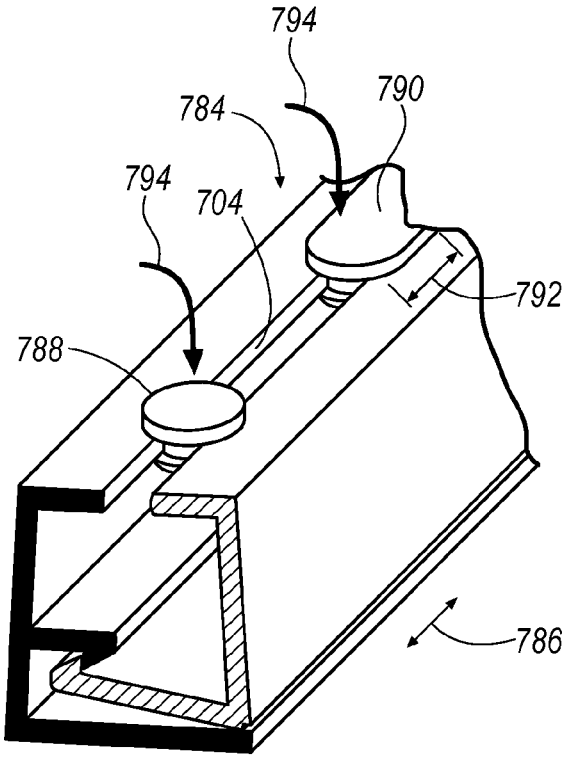
FIG. 21C illustrates a perspective view of a self-locking support system with a dome-shaped bead.

FIG. 21C illustrates MTCP or self-locking support system or assembly 784 while further illustrating the components in a perspective view to show the extension of components along an axial direction 786. As shown, dome-shaped locking bead 750 may be a short bead that appears somewhat as a "button" 788. In another example and as shown, dome-shaped locking bead 750 may be an extended piece 790 that extends along axial length 786, having its own length 792 that may extend over a portion of the total length of assembly 784, or extend the entire length of assembly 784. The "button" bead 788 and the extended bead 790 may be pressed 794 into space 704. Thus, there may be a few short beads 750 along axial length 786 and with gaps in between beads 750, or there may be one or longer beads 750, or any mix thereof. In such fashion, beads 750 cause profiles 600, 650 to be placed into pre-tension as described, allowing the overall assembly to be transported and positioned within a larger assembly or in construction of large buildings such as skyscrapers.

Figure 22A:
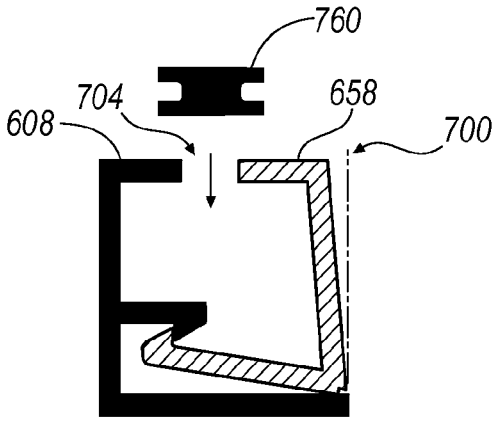
FIGS. 22A and 22B illustrate engagement of a self-locking support system.
Figure 22B:
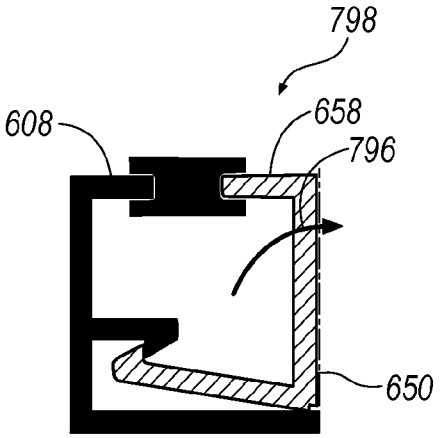

In another example, referring to FIG. 22A, sub-assembly 700 is illustrated having H-shaped locking bead 760 shown proximate thereto. As discussed, locking bead 760 is positioned in space 704 and between tips 608, 658 (although as stated, H-shaped locking bead 760 in one example is slid in from an axial end of an assembly and not necessarily pressed in, as in the case of bead 750, but is shown for illustrative purposes prior to being positioned in the assembly). FIG. 22B shows locking bead 760 in position, with tips 608, 658 pushed apart, forcing male profile 650 to distort or elastically deflect 796, which places the overall assembly 798 in a state of pre-tension, such that assembly 798 may be moved and positioned at, for instance, a construction site or within a mechanical assembly.

Figure 22C:
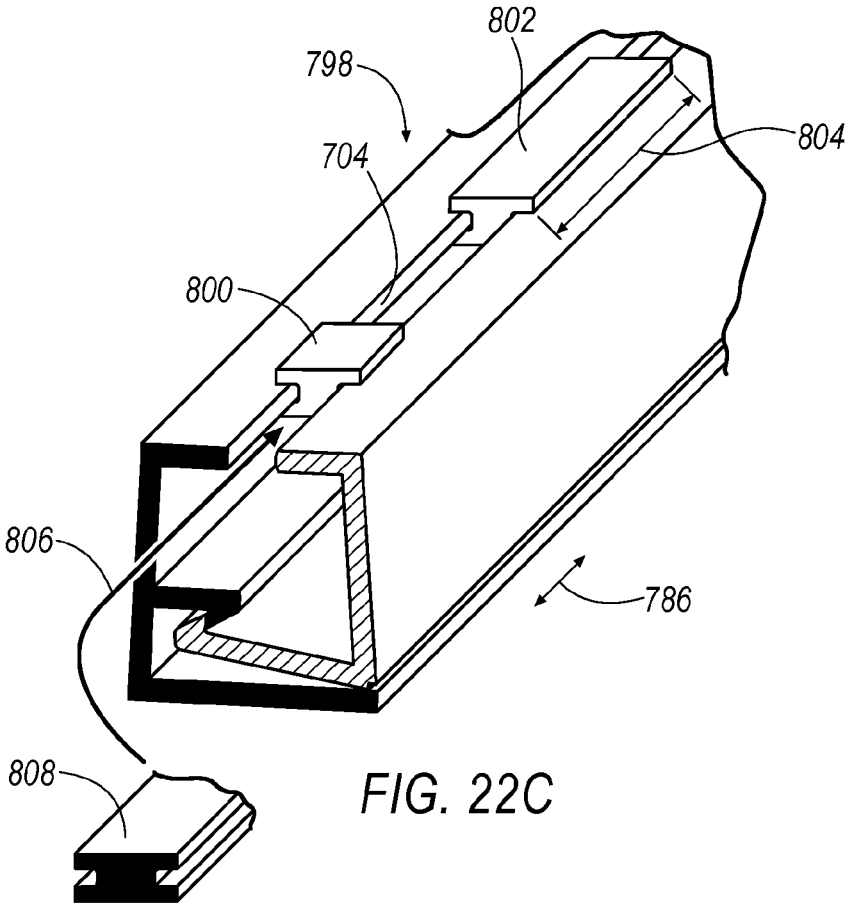
FIG. 22C illustrates a self-locking support system in a perspective view and showing a locking bead.

FIG. 22C illustrates MTCP or self-locking support system or assembly 798, while further illustrating the components in a perspective view to show the extension of components along axial direction 786. As shown, H-shaped locking bead 760 may be a short bead 800. In another example and as shown, H-shaped locking bead 760 may be an extended piece 802 that extends along axial length 786, having its own length 804 that may extend over a portion of the total length of assembly 798, or extend the entire length of assembly 798. Bead 800 and the extended bead 802 may be slid 806 into space 704—both of which are generally represented by bead 808 that is positioned at an axial end of the overall assembly 798. Thus, there may be a few short beads 800 along axial length 786 and with gaps in between beads 800, or there may be one or longer beads 802, or any mix thereof. In such fashion, beads 800 cause profiles 600, 650 to be placed into pre-tension as described, allowing the overall assembly to be transported and positioned within a larger assembly or construction.

Figure 23:
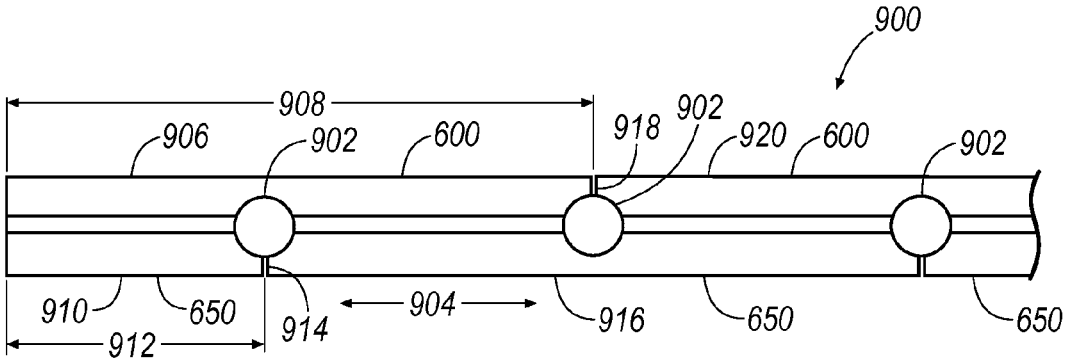
FIG. 23 illustrates a plan or top view of a self-locking support system.

FIG. 23 illustrates a plan or top view of an assembly 900 that, for illustration purposes, is a MTCP or self-locking support system or assembly that includes male profiles 650 and female profiles 600 that are caused to be engaged and placed into pre-tension using locking beads 902 that are of the dome-shaped press-in type as described above in FIG. 20A and FIGS. 21A-21C. However, it is contemplated that other locking beads may be used such as either the press-in type that extends along the axial length of the assembly (element 788 in FIG. 21C) or either of the H-shaped slide-in locking beads (elements 800 and 802 in FIG. 22C).

As illustrated in FIG. 23, each of the female and male profiles 600, 650 extends in an axial direction 904, and each having lengths along axial direction 904. In the illustrated embodiment, a first female profile 906 includes a length 908, and a first male profile 910 includes a length 912. In such fashion, breaks occur between abutted components such that the breaks are staggered from one another and do not occur at the same axial location. Similarly the locking beads also do not break at the same joints of male or female profiles. By keeping the joints of the locking beads away from the breaking points of the male or female profiles, the sudden/momentary loss/drop of strength at such breaking points/joints are physically supported by the locking bead and the MTCP Structure.

For instance, a break 914 occurs between first male profile 910 and a second male profile 916, and a break 918 occurs between first female profile 906 and a second female profile 920. Breaks 914 and 918 are shown having a gap between axial components, but it is contemplated that the components may abut one another. Locking beads 902 are positioned at least at the breaks 914, 918 to add stability and overall robustness to the assembly. Thus, in this example, break 914 between male profiles 910, 916 occurs within the length 908 of the first female profile 906, and the lengths alternate from one another such that the breaks within the corresponding male and female profiles are staggered from one another and do not abut or meet at the same axial location.

Disclosed is an illustrative method of manufacturing a self-locking support system. The method includes forming a female profile having a first vertical leg extending approximately orthogonally from a base, a first locking leg extending from the first vertical leg, and a first tip extending from the first vertical leg, wherein a gap is formed between the base and the first locking leg, forming a first male profile having a fulcrum formed at an intersection of a second vertical leg and a second locking leg, the second vertical leg having a second tip extending therefrom, forming the second locking leg such that it can be inserted into the gap, and forming a locking bead to be positioned between the first and second tips, causing the first male profile to rotate about the fulcrum, and causing the first and second locking legs to engage against each other.

Also disclosed is an exemplary approach to assembling a self-locking support system. The method includes providing a female profile at a first length and extending in an axial direction. The female profile includes a first vertical leg that extends approximately orthogonally from a base, a first locking leg extending from the first vertical leg, and a first tip extending from the first vertical leg. A gap is formed between the base and the first locking leg. The method includes providing a first male profile having a fulcrum formed at an intersection of a second vertical leg and a second locking leg, the second vertical leg having a second tip, the first male profile extending in the axial direction, inserting the second locking leg into the gap, and positioning a locking bead between the first and second tips, causing the first male profile to rotate about the fulcrum, and causing the first and second locking legs to engage against each other.

According to one example, the male and female profiles are aluminum extrusion profiles of a glazing system in which hand pressure is used to insert the rubber beadings. Regarding the locking beads, a metal extrusion uses the two types of beads disclosed: press-in fit having a dome head bottom followed by a pair of grooves, each on the sides near the top surface—for press-in fit; and slide-in fit having an "H" shaped profile to be slide-in fit mechanically through the ends (with the help of guide to avoid friction) to avoid deformation and yield maximum tension. Tension of profiles can be managed by adjusting the size of grooves or the size of space between the horizontal tips of the profiles. That is, for bigger grooves or lesser space between the vertical legs, the tension is increased. The "H" shaped locking bead is compact and plain, so adaptable to any structures and suitable for running wires or cables also.

Thus, the interlocking profiles are engaged by tilting the male profile outward on its built in fulcrum and the locking bead is inserted by the dome head bottom first (followed by a pair of grooves) into the narrow space provided between the horizontal tips of the vertical legs using force to move away the horizontal tip of the male profile (taking advantage of the tensile nature of the metal profiles) to allow passage into the dome head bottom until pressed-in past the grooves of the locking bead, which lends a unique dynamism to the mechanism.

In operation, the tensile nature of the vertical legs causes a mating action in a locking chamber where engagement occurs, and the resulting equal and opposite reaction keeps the locking bead in equilibrium between the horizontal tips of both the male and female profiles by means of the built in fulcrum. Thus, by a state of equilibrium is achieved in the mechanism by the locking bead, which may appear neutral, but is in effect subject to maximum pressure from the action/reaction caused by the interlocking mechanism.

Accordingly, the interconnected male and female profiles also undergo approximately the same pressure (or tension due to pull and push) from the interlocking mechanism, in a design such as illustrated herein. As such, the male and female profiles also experience the same or equal pressure/tension, resulting in each profile in the mechanism remaining in equal pressure (tension due to stress/strain) in a cyclical manner (back and forth or clockwise/anticlockwise) due to the dynamism of the mechanism and remaining together (without failure/rejection) while maintaining a balanced posture (neutrality/equilibrium) among the profiles. The insertion of the dome head locking bead between the horizontal tips results in a back and forth action created by tension in the locking mechanism. That is, for bigger grooves, more tension is created, but generally proportional to the strength of the interlocking profiles. In other examples, the male and female profiles may be sized so that the tips are offset from one another (i.e. one of the vertical legs is longer than the other), or the geometric relationship between the components or profiles may be altered to a degree. In these alternatives, as examples, forces may not be equal and opposite, and the press-fit component (i.e., the bead) may be designed accordingly. However, equilibrium is still maintained according to the disclosure such that the overall structure interconnects.

Due to inherent dynamism in the interlocking mechanism, the profiles of MTCP held in equilibrium (under a balanced pressure), causes to form a circle of force (or ring of force/clockwise/anticlockwise) in and around the profiles for keeping them together. The same force functions longitudinally also with same consistency (the circle of force runs through the length of the MTCP profiles) and that is the phenomena of the current interlocking mechanism.

In the disclosed mechanism, there are three profiles and four points of contacts between the profiles (in which three contacts are open ended and one is interlocked). Among the group of three, each profile is held under pressure and interconnected to each other by four points of contacts between the profiles (longitudinal throughout the length of MTCP) and each profile under pressure, meeting opposite profiles with the same opposite forces to neutralize each other, and the line of contact remain stable (if the forces are unequal, the line of contact becomes unstable and the profile deforms).

Between each of the points of contact among the profiles, there are four neutral lines passing through the profile's longitudinally to retain the profile's stability in the system and each neutral line runs between two edges of adjacent profiles which are under tension by the mechanism to meet and react with each other to neutralize the forces to be contained in the system. The neutral lines run parallel, between and along the edges of the adjacent profiles which are under tension. This means, there are two opposite linear forces/tension/power line running on either side of each of these neutral lines. This may be called as a linear force/tension/power line of power.

As such, disclosed is a MTCP system that is a powerful structural unit that has high load bearing capability and can withstand high external force/pressure. Each profile has bends at different parts and locations, different body mass (metal) at different locations and directions, especially at the contact points of each profile, causing a different resistance pattern from different angles and that also improve the ability and stability of the mechanism for more load bearing and high resistance to external forces. Further, the intermittent joints of each profile in the self-locking support structure (MTCP) enables to contain expansion/contraction due to weather (temperature) to the maximum in the MTCP while continuous/welded structures tends to deform/bend.

Further, the strength of the profiles depends on the thickness and number of bends. As such, more thickness or more bends or both together in a profile attributes more strength or more resistance to forces. Profiles tend to bend easily towards a weaker or thinner side (lesser body mass). Thus, more body mass concentration on any side of a profile is more resistant to bending. For example, a stiffener may be welded to engineering structures, welding joints, overlapping sheets welded/riveted etc.

In the MTCP, a group of profiles in which each profile is tensioned by the introduction of the locking bead, causing a cycle of action by force within the group of profiles, and a line of force develops within. In the interlocking system, although the MTCP maintains a firm grip on each profile under a cycle of forces, it combines to react as a single unit to withstand loads more than other profiles of the same metal in comparable size and weight.

As steel/alloys are considered stronger than aluminum, an MTCP design in a steel/alloy extrusion profile will find more utility in structural and engineering applications. However, in other applications material such as aluminum may be desirable in which the advantage of aluminum may be its lighter weight and different elastic modulus from steel.

The MTCP has four neutral lines that extend in parallel. Each neutral line has power lines extending in parallel on either side. The MTCP also has bends at various points to enhance resistance. The MTCP is also reinforced by additional body mass at certain sections. As such, the MTCP design is a powerful mechanism that is capable of more load bearing and resistant to external forces (resulting in less material and less labor when compared to common structures such as I-beams, because the overall design is so much less weight and less cumbersome to handle). The MTCP consists of a group of pre-tensioned profiles which remain in straight line due to inherent dynamism. The MTCP affords continuous profile length achieved by adding male or female profiles one after the other as disclosed above. However, a reasonable length of space to be maintained between male and female joints. Thus cut pieces can be used to avoid wastage. In one example, the locking bead is an integral part of the overall mechanism, such as either the male or female profiles, and abutments of the locking beads are kept away from abutments of other profiles.

As such, waste is cut down, while relatively short segments may be assembled on-site to make singular and very long support structures, avoiding the need to transport single and relatively long pieces to the site or location for use. That is, typically an I-beam is transported to a construction location that is fabricated at the length of the span required. In contrast, the MTCP design allows short pieces to be transported to the site (which in one example, may be to many stories in height during for instance construction of a skyscraper). This results in tremendous cost savings in material, transportation, assembly, and construction.

The MTCP is a combination of pre-tensioned profiles and is dynamic and continuous. Factory assembled profiles can be cut to useful lengths as required without losing its strength, due the ability to assemble the unit with the profiles being abutted in staggered axial locations as described.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

While the disclosed subject matter has been described in detail in connection with only a limited number of embodiments, it should be readily understood that the disclosed subject matter is not limited to such disclosed embodiments. Rather, that disclosed can be modified to incorporate any number of variations, alterations, substitutions or equivalent arrangements not heretofore described, but which are commensurate with the spirit and scope of the disclosed subject matter. Additionally, while various embodiments have been described, it is to be understood that disclosed aspects may include only some of the described embodiments. Accordingly, that disclosed is not to be seen as limited by the foregoing description, but is only limited by the scope of the appended claims.

What is claimed is:

1. A self-locking support system, comprising:

a female profile having a first profile leg extending approximately orthogonally from a base, a first locking leg extending from the first profile leg, and a first tip extending from the first profile leg, wherein a gap is formed between the base and the first profile leg; and a first male profile having a fulcrum formed at an intersection of a second profile leg and a second locking leg, the second profile leg having a second tip extending therefrom;

wherein the second locking leg is inserted into the gap, and a locking bead is positioned between the first and second tips, the first male profile is caused to rotate about the fulcrum and the first and second locking legs are caused to engage against each other;

wherein each of the female and first male profiles extend axially, each having a respective first and second length extending in an axial direction; and wherein the first length is greater than the second length; and the system further comprising a second male profile having a cross-section that is similar to the first male profile, the second male profile extending in the axial direction, and wherein the first and second male profiles abut one another axially and within the first length of the female profile.

2. The self-locking support system of claim 1, wherein the locking bead forms a press-fit between the first and second tips, causing opposing expansion forces to form outward from one another to lock the female profile and the male profiles against one another.

3. The self-locking support system of claim 1, comprising multiple male and female profiles having cross-sections respectively similar to the first male profile and the female profile, wherein the multiple male and female profiles extend axially and are displaced axially with respect to one another such that abutments of male profiles do not abut at the same axial location as abutments of female profiles.

4. The self-locking support system of claim 1, wherein the locking bead is a press-in locking bead having a surface that is positioned between the first and second tips to force the first and second tips apart and cause engagement of the first locking leg with the second locking leg.

5. The self-locking support system of claim 1, wherein the locking bead is an H-shaped profile having two gaps in the H-shape, such that the first tip is positioned within one of the gaps, and the second tip is positioned within the other of the gaps, causing engagement of the first locking leg with the second locking leg.

6. The self-locking support system of claim 1, wherein the first tip extends approximately orthogonally to the first vertical leg, and the second tip extends approximately orthogonally to the second vertical leg.

7. A method of manufacturing a self-locking support system, the method comprising:

providing a female profile having a first length extending in an axial direction and having a first vertical leg extending approximately orthogonally from a base, a first locking leg extending from the first vertical leg, and a first tip extending from the first vertical leg, wherein a gap is formed between the base and the first locking leg;

providing a first male profile having a second length extending in the axial direction and having a fulcrum formed at an intersection of a second vertical leg and a second locking leg, the second vertical leg having a second tip extending therefrom;

inserting the second locking leg into the gap;

positioning a locking bead between the first and second tips;

rotating the first male profile about the fulcrum, such that the first and second locking legs engage against each other;

providing a second male profile having a cross-section that is the same as the first male profile, the second male profile extending in the axial direction; and positioning the first and second male profiles to abut one another axially and within the first length of the female profile;

wherein the first length is greater than the second length.

8. The method of claim 7, comprising forming a press-fit between the first and second locking tips, causing opposing expansion forces to form outward from one another to lock the female profile and the male profiles against one another.

9. The method of claim 7, further comprising:

positioning multiple male and female profiles having cross-sections that are respectively the same as the first male profile and the female profile, wherein the multiple male and female profiles extend axially; and displacing the male and female profiles axially with respect to one another such that abutments of male profiles do not abut at the same axial location as abutments of female profiles.

10. The method of claim 7, further comprising pressing the locking bead between the first and second tips to force the first and second tips apart to cause engagement of the first locking leg with the second locking leg.

11. The method of claim 7, further comprising sliding the locking bead from an axial end of the system to cause engagement of the first locking leg with the second locking leg.

12. A method of assembling a self-locking support system, the method comprising:

providing a female profile at a first length and extending in an axial direction, the female profile having:

a first vertical leg that extends approximately orthogonally from a base;

a first locking leg extending from the first vertical leg;

a first tip extending from the first vertical leg; and a gap formed between the base and the first locking leg;

providing a first male profile at a second length and extending in the axial direction, the male profile having a fulcrum formed at an intersection of a second vertical leg and a second locking leg, the second vertical leg having a second tip, the first male profile extending in the axial direction;

inserting the second locking leg into the gap;

positioning a locking bead between the first and second tips, utilizing the fulcrum to rotate, causing the first and second locking legs to engage against each other;

providing a second male profile having a cross-section that is the same as the first male profile, the second male profile extending in the axial direction; and positioning the first and second male profiles to abut one another axially and within the first length of the female profile;

wherein the first length is greater than the second length.

13. The method of claim 12, further comprising:

providing multiple male and female profiles having cross-sections that are respectively the same as the first male profile and the female profile, wherein the multiple male and female profiles extend axially; and displacing the male and female profiles axially with respect to one another such that abutments of male profiles do not abut at the same axial location as abutments of female profiles.

14. The method of claim 12, further comprising pressing the locking bead between the first and second tips to force the first and second tips apart to cause engagement of the first locking leg with the second locking leg.

15. The method of claim 12, further comprising installing the locking bead between the first and second tips to force the first and second tips apart by sliding the locking bead in from an axial end of the self-locking support system to cause engagement of the first locking leg with the second locking leg.

16. A self-locking support system, comprising:

a female profile having a first profile leg extending approximately orthogonally from a base, a first locking leg extending from the first profile leg, and a first tip extending from the first profile leg, wherein a gap is formed between the base and the first profile leg; and a first male profile having a fulcrum formed at an intersection of a second profile leg and a second locking leg, the second profile leg having a second tip extending therefrom;

wherein the second locking leg is inserted into the gap, and a locking bead is positioned between the first and second tips, the first male profile is caused to rotate about the fulcrum and the first and second locking legs are caused to engage against each other; and wherein the locking bead is an H-shaped profile having two gaps in the H-shape, such that the first tip is positioned within one of the gaps, and the second tip is positioned within the other of the gaps, causing engagement of the first locking leg with the second locking leg.

* * * * *